US011668111B2

(12) United States Patent
Hui et al.

(10) Patent No.: US 11,668,111 B2
(45) Date of Patent: Jun. 6, 2023

(54) POOL CLEANING VEHICLE

(71) Applicant: NATIONAL WISE LIMITED, Hong Kong (CN)

(72) Inventors: Martin Wing-Kin Hui, Hong Kong (CN); Wing-Tak Hui, Hong Kong (CN); Andrew Matthew Hui, San Jose, CA (US)

(73) Assignee: National Wise Limited, Hong Kong (HK)

( * ) Notice: Subject to any disclaimer, the term of this patent is extended or adjusted under 35 U.S.C. 154(b) by 0 days.

(21) Appl. No.: 17/509,542

(22) Filed: Oct. 25, 2021

(65) Prior Publication Data

US 2022/0042338 A1 Feb. 10, 2022

Related U.S. Application Data

(62) Division of application No. 16/569,240, filed on Sep. 12, 2019, now Pat. No. 11,441,326.

(51) Int. Cl.
*E04H 4/16* (2006.01)

(52) U.S. Cl.
CPC ..... *E04H 4/1654* (2013.01); *E04H 4/16* (2013.01)

(58) Field of Classification Search
CPC ..... E04H 4/16; E04H 4/1652
See application file for complete search history.

(56) References Cited

U.S. PATENT DOCUMENTS

2014/0165306 A1* 6/2014 Hui ..... E04H 4/1654 15/1.7
2014/0165307 A1* 6/2014 Hui ..... E04H 4/1654 15/1.7
2015/0121636 A1* 5/2015 Hui ..... E04H 4/1654 15/160
2017/0284116 A1* 10/2017 Gopalan ..... E04H 4/1654

* cited by examiner

*Primary Examiner* — Michael D Jennings
(74) *Attorney, Agent, or Firm* — Jeffrey D. Moy; Weiss & Moy, PC

(57) ABSTRACT

A pool cleaning vehicle having a suction mouth placed at the belly of a housing. The pool cleaner is placed on two elongate rollers which allow the pool cleaner to move in opposite directions. The suction mouth is positioned between the two elongate rollers to reduce angular displacement when a roller wheel mounts a protrusion on uneven pool bed. A scrubber extends from within the mouth to sweep across the pool bed. The scrubber is pivoted to be able to swing when the pool cleaner changes direction.

4 Claims, 14 Drawing Sheets

POOL CLEANING VEHICLE

FIELD OF INVENTION

This invention relates to automated pool cleaning devices, such as self-propelled pool cleaning vehicles (PCV's).

BACKGROUND OF INVENTION

Swimming pool maintenance is a tedious affair. Floating debris such as fallen leaves and dead insects, as well as sunken debris such as sand and stones need to be removed regularly. Floating debris can be easily captured by pool skimmers or nets; a pool janitor does not need to enter a pool to capture floating debris. On the other hand, however, a pool janitor often has to enter a pool to pick sunken debris from the pool bed.

To avoid getting the janitor wet and tired, vacuum cleaners for pools have been provided. These vacuum cleaners comprise a vacuum head which is connected to an extension wand by which the janitor may manipulate the vacuum head. The vacuum head is also connected to a vacuum hose, which is in turn connected to a pump to deliver a suction force at the vacuum head. The janitor has to move the vacuum head over the pool bed like someone would push a dry ground vacuum head over a floor. However, it is back breaking work to exert against water resistance, especially when the wand is a long one. Furthermore, it is time consuming for the janitor to move the vacuum head over the entire pool bed.

Robotic pool cleaners have been provided which could traverse a pool bed without need of a human operator. Typically, these pool cleaners are shaped like a big disc having a mouth on side, and wheels under the disc for moving the disc on the pool bed. The disc moves across the pool bed with the side having the mouth being the front, and the mouth sucks in water and debris as the cleaner move towards the debris. The cleaner dispels the sucked in water but a filter traps the debris.

The concept for these robotic pool cleaners was borrowed from robotic vacuum cleaners for dry floors, in domestic use. However, most of the rubbish which robotic vacuum cleaners are expected to pick up is lightweight, such as hair and dust. Heavier rubbish like pieces of broken porcelain normally requires manual cleaning.

Accordingly, the dry land concept is not suitable for pool bed deployment. Sunken debris often has density greater than that of water. Hence, robotic pool cleaners are sometimes inefficient in picking up debris on pool beds. The inefficiency is worse on an uneven pool bed. If the wheels beneath the disc roll over a protrusion on the pool bed, the mouth of the pool cleaner is lifted away from the pool bed. This leaves the uneven pool bed unevenly cleaned.

Accordingly, it is desirable to provide a pool cleaning vehicle which has better efficiency at cleaning, and is preferably capable of cleaning uneven pool bed.

SUMMARY OF THE INVENTION

In the first aspect, a pool cleaning vehicle comprising: a housing having a base; a mouth on the base for sucking debris on the bed of a pool; and a scrubber extending from within the mouth to agitate the debris. By extending from within the mouth, the scrubber ensures that any agitated debris could be immediately buoyed by water current created by the suction at the mouth, and be sucked in.

Optionally, the scrubber can be fixed to an edge of the mouth, or the side of the mouth. However, this is not the most preferable because, if the pool cleaning vehicle is moving in a direction such that the scrubber is moving ahead of the mouth, the scrubber could shovel debris out of the way of the mouth instead of causing debris to be stirred up and caught by the suction at the mouth. Preferably, therefore, the scrubber extends from within the mouth, ensuring that agitation of debris from their resting place by the scrubber is coincident with the suction at the mouth.

Preferably, the scrubber has a height that is longer than the distance between the point by which the scrubber is connected to the housing and the pool bed; such that the scrubber lies on the pool bed at an angle as the pool cleaner vehicle traverse the pool bed. When the pool cleaning vehicle moves in one direction, the scrubber swings to the opposite direction and is dragged along by the pool cleaning vehicle. This causes debris to be swept along as the mouth moves, which increases the chance that debris which is swept along with the mouth may be caught by the suction at the mouth.

Preferably, the scrubber is capable of moving inside the mouth. For example, the scrubber is capable of swinging inside the mouth. Preferably, the scrubber is capable of movements orthogonal to the pool bed. In this case, the scrubber may be connected to the housing by a pivot in a sliding guide for providing the orthogonal movements. Orthogonal to the pool bed when the pool cleaning vehicle is deployed to clean the pool bed usually means the vertical direction. This allows the scrubber to be lifted up over protrusions on uneven pool beds so that movements of the pool cleaning vehicle is not withstood by the protrusions, or even allows the scrubber to drop into crevices on pool beds to clean the crevices. If the pool cleaning vehicle has wall climbing abilities, then orthogonal is taken with reference to the pool wall that is being cleaned.

Optionally, the scrubber is capable of movements along the pool bed relative to the housing. That is, if the pool cleaning vehicle is deployed to clean a pool bed, the scrubber is capable of moving relative to the housing horizontally, i.e. substantially parallel to the pool bed. Typically, the scrubber is connected to the housing by a connector in a sliding guide for guiding the movements relative to the housing.

In a second aspect, the invention proposes a pool cleaning vehicle comprising: a housing; and a scrubber pivoted to the housing to agitate the debris. This provides the advantage of the scrubber being capable of swinging over from an initial position when the pool cleaning device reverses movement directions.

In a third aspect, the invention proposes a pool cleaning vehicle comprising: a housing; and a scrubber slide-ably connected to the housing. The scrubber may or may not also be pivoted to the housing to be capable of swinging. A scrubber that is movable relative to the housing provides a greater possibility of different manoeuvres to overcome protrusions on pool beds and to agitate different types of debris in different ways. Preferably, the scrubber is capable of movements orthogonal to the pool bed. For example, the scrubber is connected to the housing by a pivot in a sliding guide for providing the orthogonal movements. Optionally, the scrubber is capable of horizontal movements relative to the housing, i.e. along the pool bed. For example, the scrubber is connected to the housing by a connector in a sliding guide for guiding the horizontal movements.

In a further aspect, the invention proposes a method of cleaning a pool bed comprising the steps of: providing scrubber extending from within the mouth of a suction cleaner; scrubbing debris on the pool bed using the scrubber;

wherein debris which is agitated by the scrubber is sucked by the suction at the mouth. In contrast to a scrubber that is located adjacent the mouth, a scrubber that extends from within the mouth is more capable of agitating debris to be picked up and buoyed by water currents created by the suction. This is because the location of debris agitation is coincident with the location of the mouth providing suction.

Preferably, the method further comprises dragging the scrubber as the suction cleaner moves. That is, the scrubber is being dragged along on the pool bed despite already extending from within the mouth. When the scrubber is dragging behind the direction of movement, the scrubber is able to sweep debris along as the mouth of suction cleaner moves across the pool bed, increasing the probability of debris being picked up by the suction. In contrast, if the scrubber is located such that it is moving ahead of the mouth of the suction cleaner, debris may be shoved away from the suction.

Optionally, the method further comprises lifting the scrubber over a protrusion on the pool bed as the suction cleaner moves over the protrusion.

Optionally, the method further comprises lowering the scrubber into a crevice on the pool bed as the suction cleaner moves over the crevice.

BRIEF DESCRIPTION OF THE DRAWINGS

It will be convenient to further describe the present invention with respect to the accompanying drawings that illustrate possible arrangements of the invention, in which like integers refer to like parts. Other arrangements of the invention are possible, and consequently the particularity of the accompanying drawings is not to be understood as superseding the generality of the preceding description of the invention.

DESCRIPTION OF EMBODIMENTS

Figure 1:
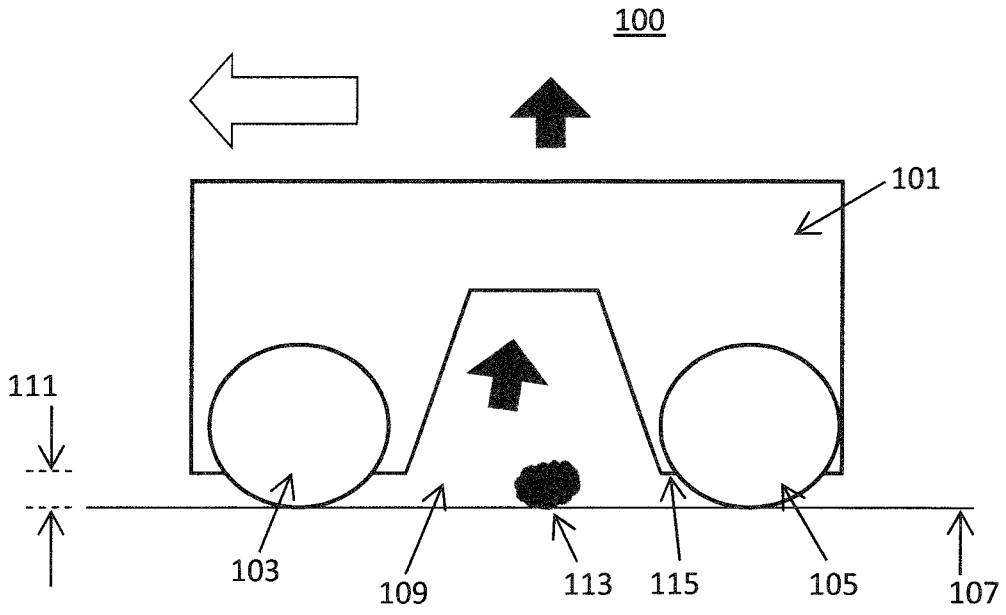
FIG. 1 shows an embodiment of the invention.

FIG. 1 is a schematic drawing of an embodiment, and shows the side view of a pool cleaning vehicle (PCV) 100 which is capable of submerging into water in a swimming pool and of moving on the bed of the pool to clean the bed 107.

The PCV 100 comprising a housing 101 which is typically made of plastic. The housing 101 is mounted on two rollers 103, 105 which act as wheels on which the PCV 100 moves. The height of the rollers 103, 105 determines the distance 111 between the belly 115, or base, of the housing 101 and the pool bed 107. One 103 of the rollers is nearer to one end of the housing 101, while the other roller 105 is nearer to the opposite end of the housing 101.

The housing 101 has a mouth 109 on its belly 115, and the mouth 109 is situated between the rollers 103, 105. The rollers 103, 105 extend across the width of the housing 101 (see FIG. 3). Similarly, the mouth 109 extends across the width of the housing 101.

Inside the housing 101 and protected from the water are electronic and electrical components (not illustrated), including a microcontroller for operating the PCV 100. Generally, the microcontroller drives the rollers 103, 105.

The rollers 103, 105 can rotate in the reverse. This allows the PCV 100 to move forward and backward on the pool bed 107 without having to turn itself around. In FIG. 1, the PCV 100 moves in the direction indicated by the white arrow.

Also inside the housing 101 is a motor connected to the mouth 109 via a conduit (not illustrated). When the motor is in operation, the motor draws in a stream of pool water by the mouth 109, and dispels the water from the top of the housing 101. The expulsion of water from the top of the housing 101 exerts a pressure on the housing 101, pushing the housing 101 onto the pool bed 107.

As the PCV 100 moves across the pool, debris 113 on the pool bed 107 beneath the mouth 109 is picked up and buoyed by water current that is created by the suction at the mouth 109. A filter (not illustrated) inside the housing 101 traps the debris carried by the stream of water into the housing 101.

Generally, mouth 109 is about an inch wide, and the rollers 103, 105 have a diameter of 3" each. The size of the housing 101 in some embodiments could be 16"×14"×11". The drawings are not to scale.

Figure 2:
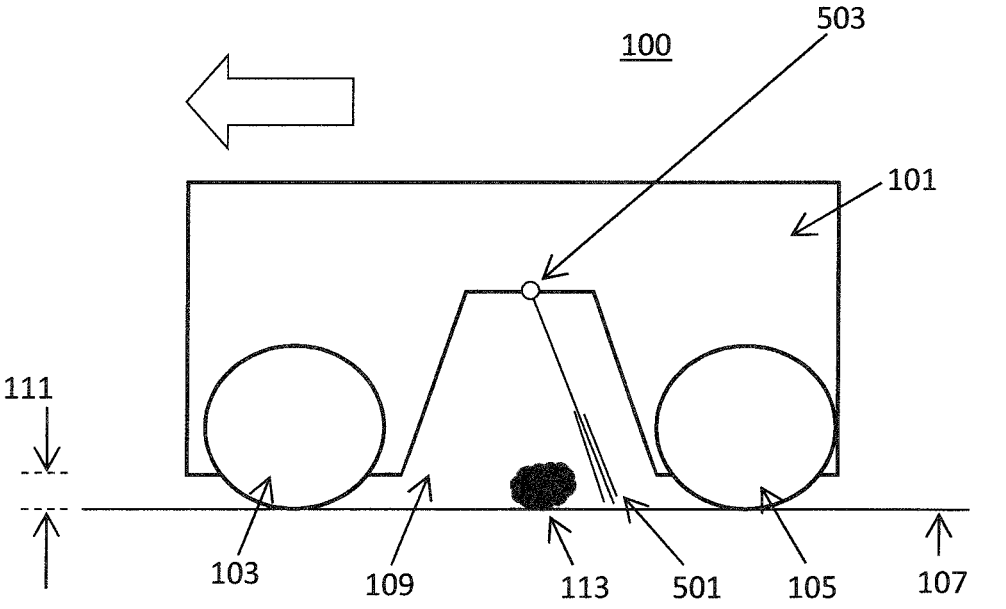
FIG. 2 shows a variation of the embodiment of FIG. 1.

Preferably, as shown in FIG. 2, the roof of the mouth 109 is fitted with a brush or scrubber 501.

Figure 3:
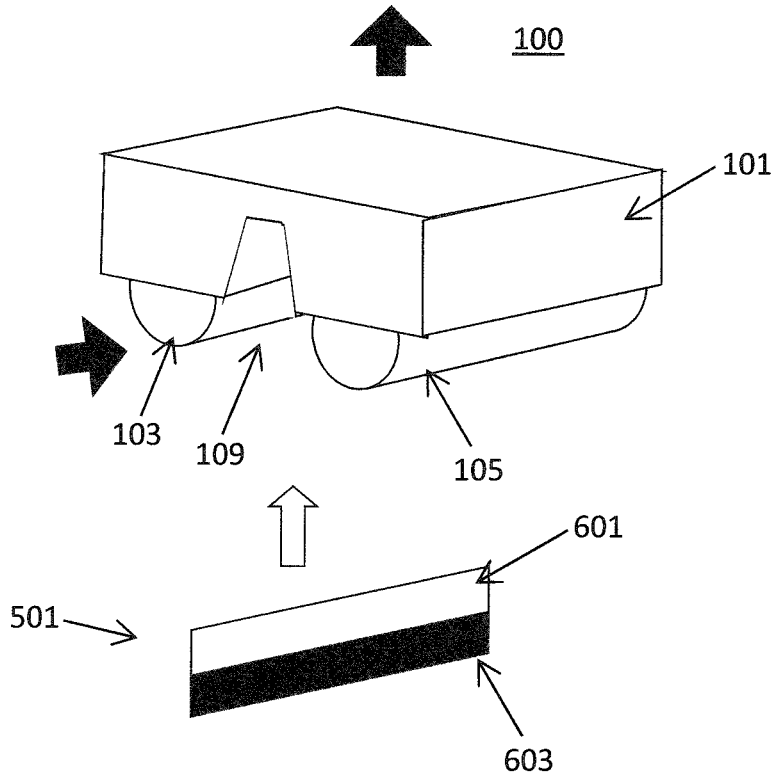
FIG. 3 is a perspective view of the illustration in FIG. 2.

FIG. 3 is an exploded perspective view of the PCV 100, the white arrow showing how the scrubber 501 fits into the mouth 109. The width (lateral) of the scrubber 501 extends across the width of the PCV 100. The rollers 103, 105 and the mouth 109 also extend across the width of the PCV 100. The black arrows show how, when the motor is in operation, water is sucked in from the side of the PCV 100 into the space between the rollers 103, 105, and up into the housing 101. In other words, water current is created lateral to the direction in which the PCV 100 moves.

The upper part of the scrubber 501 is a piece of hard board 601, and the edge of the board 601 is secured to the roof of the mouth 109 by a pivot 503, about which the scrubber 501 may turn. The lower end of the scrubber 501, or the tip 603 of the scrubber 501, is formed of bristles. The bristles are typically thick and tough plastic fibres. When the PCV 100 moves across the pool bed 107, the tip 603 of the scrubber 501 sweeps over debris 113 on the pool bed 107 to stir up stubborn debris 113. Debris 113 stirred up from the pool bed 107 can be more easily carried by water current into the mouth 109.

Preferably, the length (vertical) of the scrubber 501 is slightly greater than the distance between the pivot and the pool bed 107. Therefore, the scrubber 501 is slanted at an angle when the PCV 100 placed on the pool bed, in order to be accommodated between the pivot 503 and the pool bed 107. When the PCV 100 moves across the pool, the tip 603 of the scrubber 501 drags behind the pivot 503 and lies at an angle to the pool bed 107. This prevents the bristles from being damaged. In contrast, if the bristles were pointed in the forward direction as the PCV 100 moves, the bristles may be shoved into stubborn debris 113 and be damaged.

When the microcontroller detects that the PCV 100 has bumped against a pool wall, the PCV 100 reverses direction without having to rotate itself about on the pool bed 107. The rollers 103, 105 simply reverse turning direction.

Figure 4:
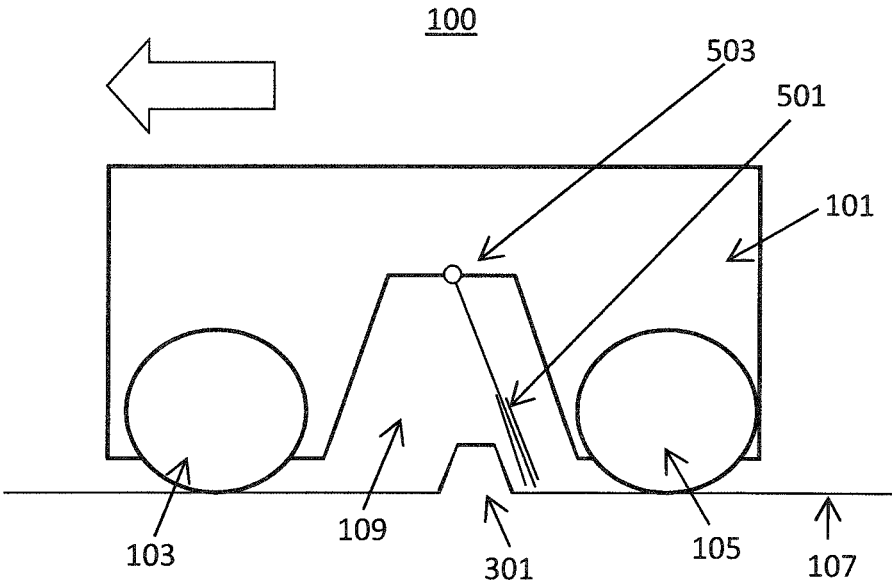
FIG. 4 illustrates an operation in the embodiment of FIG. 2.
Figure 5:
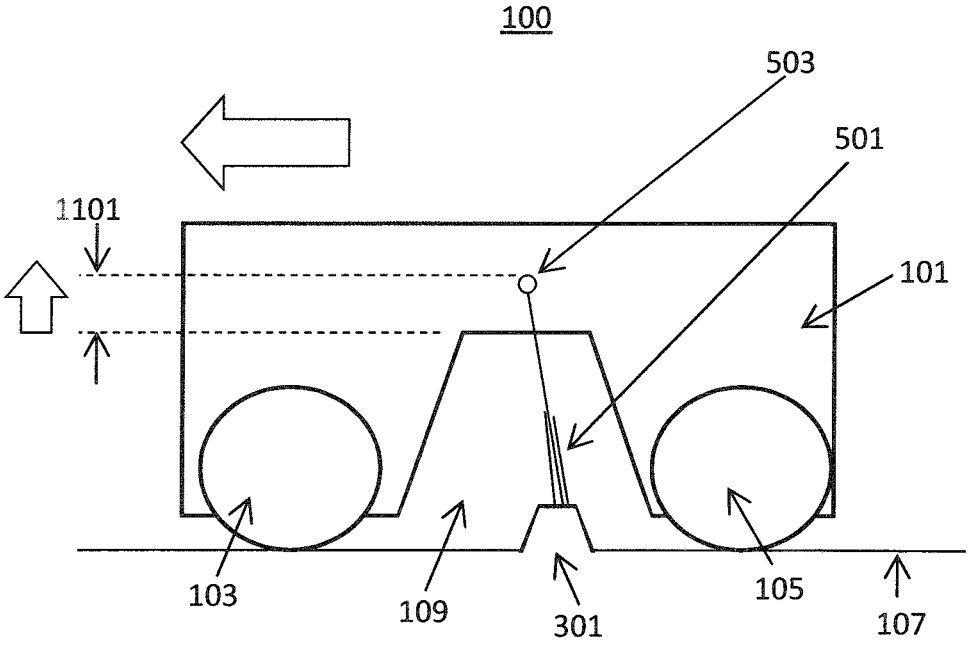
FIG. 5 further illustrates the operation of FIG. 4.
Figure 6:
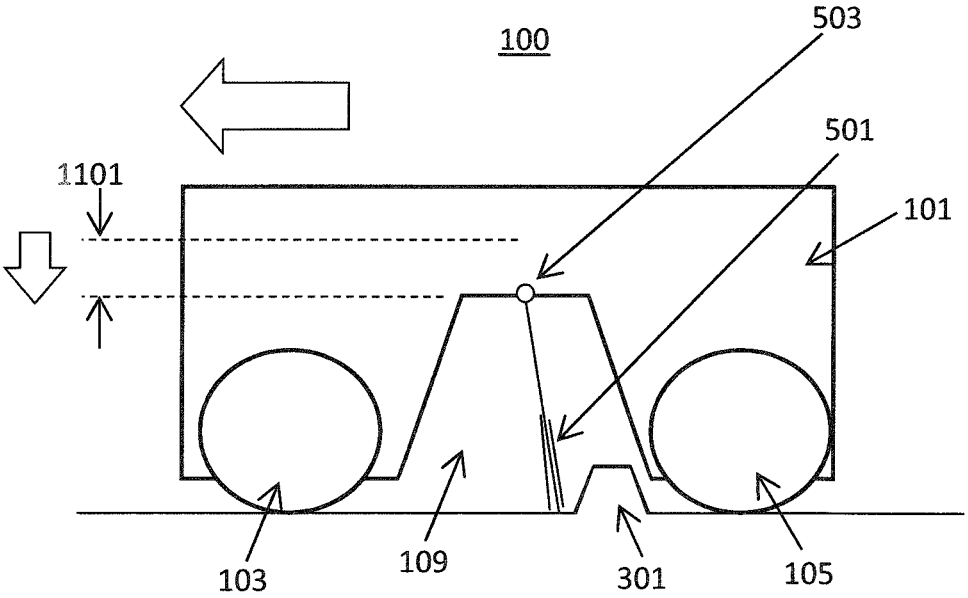
FIG. 6 further illustrates the operation of FIG. 4.

FIG. 4 shows the scrubber 501 abutting against a large protrusion 301 on an uneven pool bed 107, as it moves to the left of the drawing. As the scrubber 501 cannot remove the protrusion 301, this could stall the forward movement of the PCV 100. To overcome such obstacles, as shown in FIG. 5, the pivot 503 connecting the scrubber 501 to the roof of the mouth 109 is designed to be capable of being pushed up by resistance force acting against the scrubber 501, as indicated by the numeral 1101. This allows the scrubber 501 to be lifted and to sweep over the immovable protrusion 301. When the scrubber 501 has passed over the protrusion 301, as shown in FIG. 6, the pivot 503 falls back into the original position. There are many ways to provide such a movable pivot 503. One example is illustrated in the series of three drawings shown in FIG. 7, wherein the pivot 503 is movably held in a vertical slide guide 1301.

Figure 7:
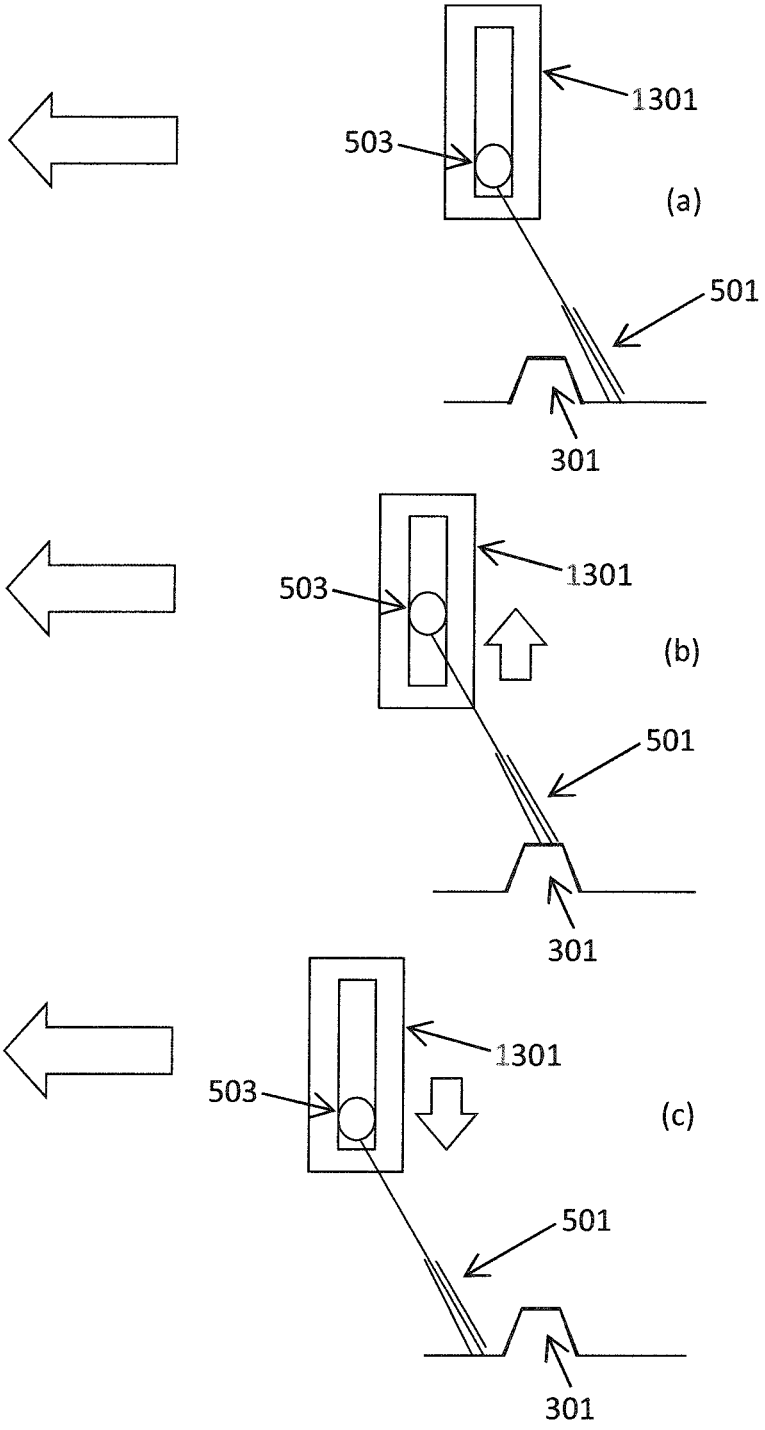
FIG. 7 further illustrates the operation of FIG. 4.

The position of the pivot 503 in the vertical slide guide 1301 as shown in FIG. 7(*a*) is the original position, and corresponds to FIG. 4 where the scrubber 501 first encounters an obstacle in the form of the protrusion 301. The position of the pivot 503 in the vertical slide guide 1301 as shown in FIG. 7(*b*) is a lifted position, as indicated by the up-pointing white arrow, and corresponds to FIG. 5 where the pivot 503 of the scrubber 501 has lifted to let the scrubber 501 sweep over the top of the protrusion 301. The extent of lifting depends on the height of the protrusion 301, as the skilled reader would appreciate. The position of the pivot 503 in the vertical slide guide 1301 as shown in FIG. 7(*c*) corresponds to FIG. 6 where the pivot 503 of the scrubber 501 has returned to the original position after having passed over the protrusion 301, as indicated by the down-pointing white arrow.

Figure 8:
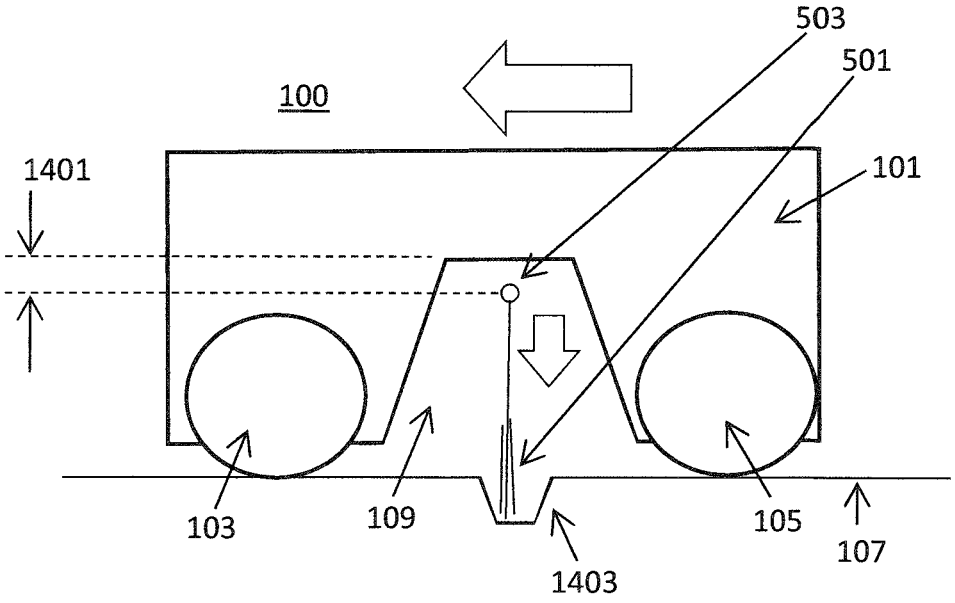
FIG. 8 also illustrates an operation in the embodiment of FIG. 2.
Figure 9:
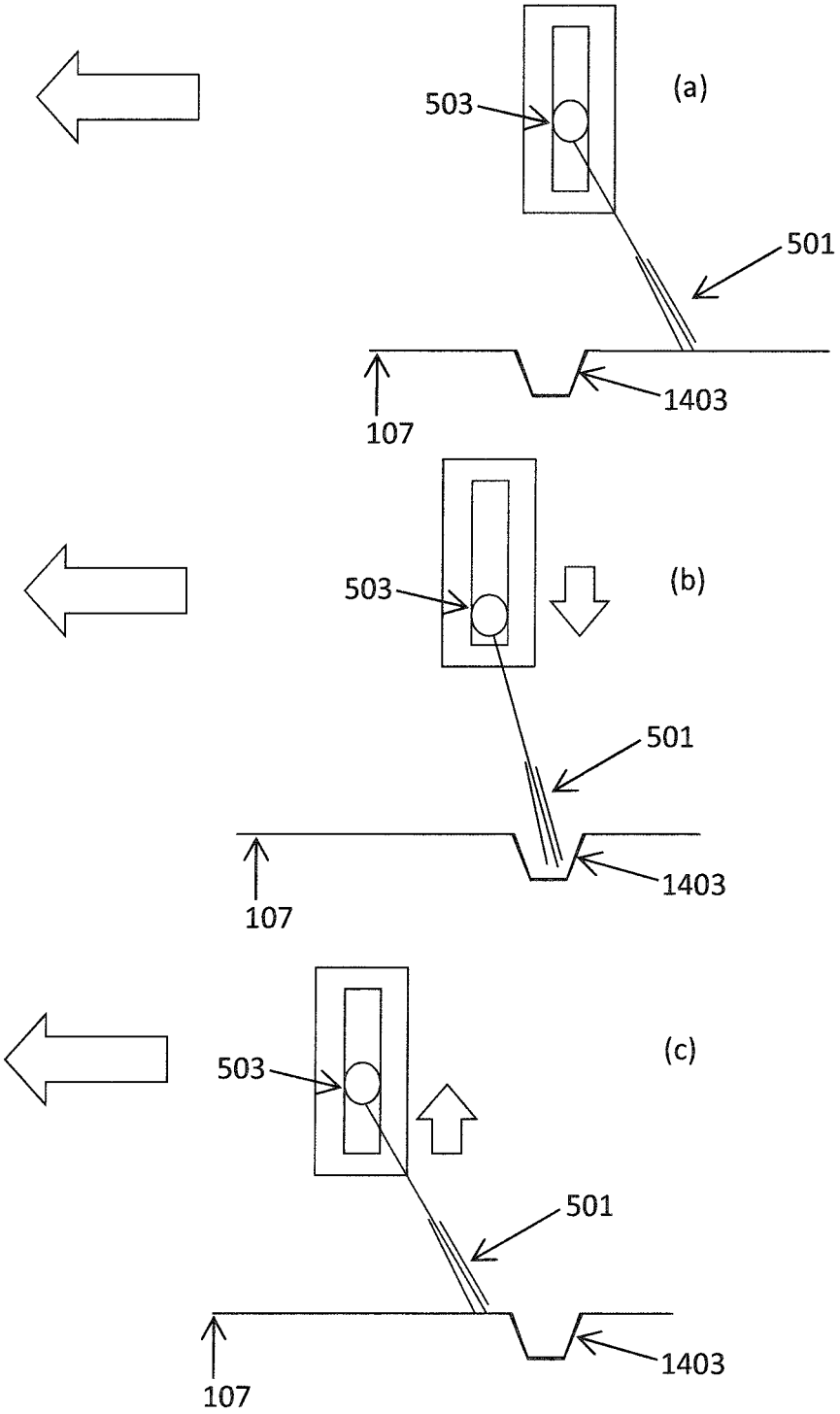
FIG. 9 further illustrates the operation of FIG. 8.

FIG. 8 illustrates that the pivot 503 in the vertical slide guide 1301 is also able to drop from the original position when the tip 603 of the scrubber 501 sweeps into a crevice 1403, as indicated by the numeral 1401 and the white arrow. FIG. 9 is a series of drawings that illustrates how the movable pivot 503 allows the scrubber 501 to dip into crevices.

FIG. 9(*a*) shows that when the scrubber 501 is sweeping across an even part of the pool bed 107, the pivot 503 is in a neutral position on the vertical slide guide 1301. When the scrubber 501 sweeps over a crevice 1403, as shown in FIG. 9(*b*), the lack of support beneath the scrubber 501 causes the pivot 503 to drop by the sheer weight of the scrubber 501. The tip 603 of the scrubber 501 therefore enters the crevice 1403 to clean the crevice 1403. When the PCV 100 moves on, as shown in FIG. 9(*c*), the scrubber 501 is pulled out of the crevice 1403, and the support of the pool bed 107 beneath the scrubber 501 lifts the pivot 503 back into the neutral position.

Figure 10:
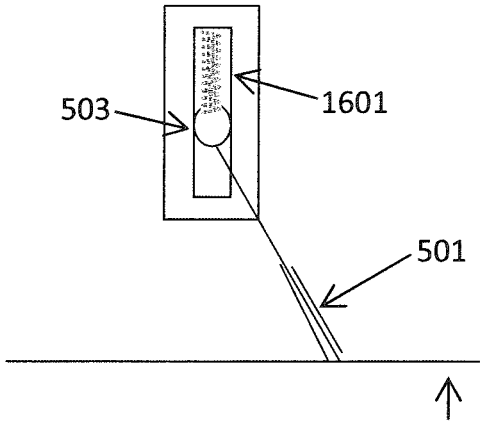
FIG. 10 shows a variation to the embodiment illustrated in FIG. 9.

The pivot 503 is freely movable up and down within the vertical slide guide 1301 because of the relative density of the materials selected to make the scrubber 501. For example, if the scrubber 501 is largely made of plastic and rubber, there relative density of the scrubber 501 as a whole can be made to be just slightly more than the density of water to provide a tiny amount of buoyancy for the scrubber to move up and down in water. However, in the preferred embodiment, a weak spring 1601 is provided to urge the pivot 503 into the neutral position, as shown in FIG. 10.

Figure 11:
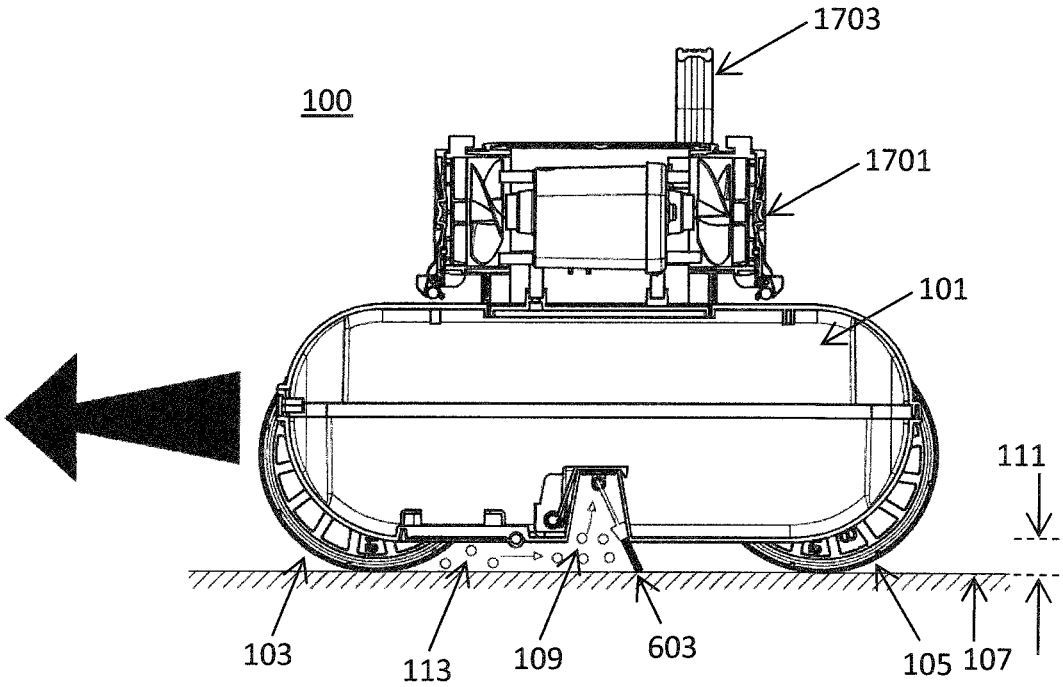
FIG. 11 shows the embodiment of FIG. 2 in greater detail.

FIG. 11 is an actual technical drawing from the side view of a PCV 100 shown having a mouth 109 at the belly 115 of the housing 101. On the top of the housing 101 is the motor 1701 for sucking in water from the mouth 109 and filter for trapping debris 113 in the stream of water passing through the PCV 100. The drawing shows an output 1703 for expulsion of water by the PCV 100. Description of other fine details of the PCV 100 is not necessary here.

Figure 12:
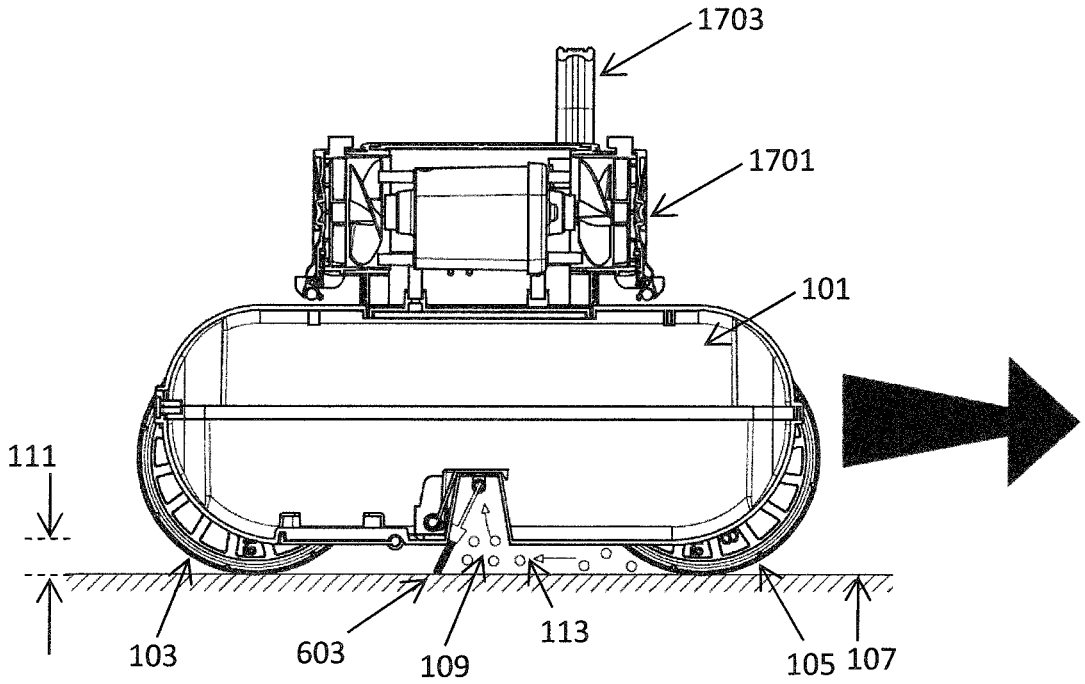
FIG. 12 shows the embodiment of FIG. 2 in greater detail.

FIG. 11 corresponds to the schematic diagram of FIG. 1. The scrubber 501 can be seen dragging on the pool bed 107 to the right side of the drawing while the PCV 100 is moving to the left side. Debris 113 is shown being sucked in from the direction of movement, and up into the mouth 109 and into the housing 101. Even though the tip 603 of the scrubber 501 is shown lagging behind the mouth 109, any debris 113 stirred up by the scrubber 501 is caught in the water current and sucked into the housing 101. This is because the agitation of the debris is substantially coincidental with the suction at the mouth. FIG. 12 shows the same PCV 100 moving in the reverse direction, and the scrubber 501 can be seen dragging on the left side.

Figure 13:
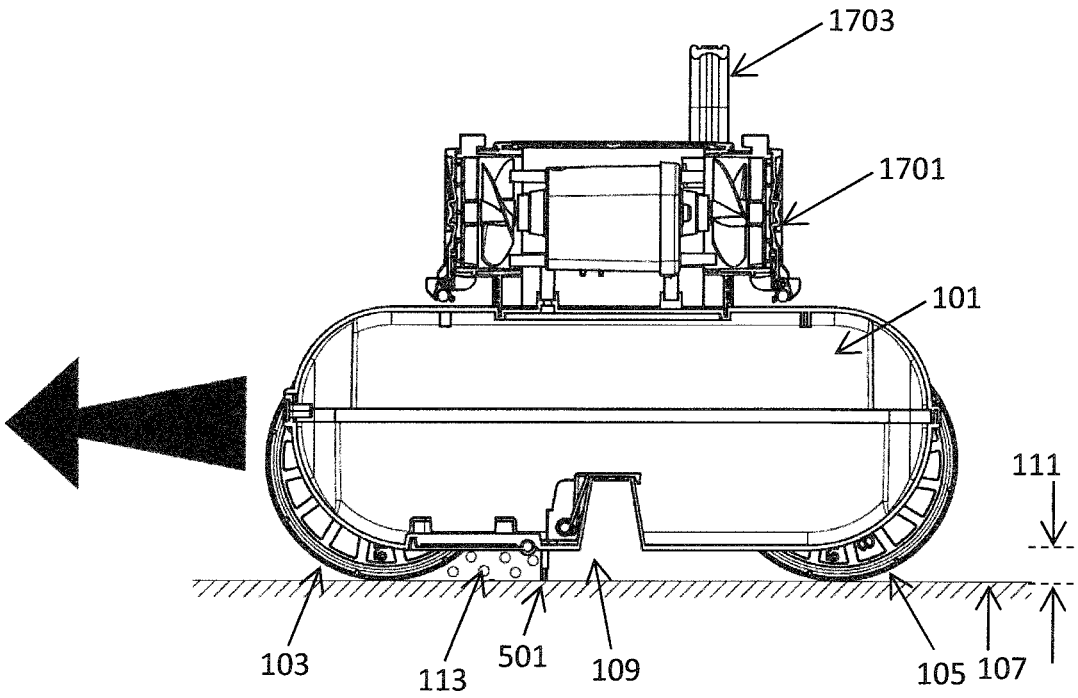
FIG. 13 shows a variation of the embodiment illustrated in FIG. 11.

In another embodiment, as shown in FIG. 13, the scrubber 501 does not extend from within the mouth 109. Instead, the scrubber 501 is a fixed in a position adjacent the mouth 109. When the scrubber 501 sweeps over debris 113 on the pool bed 107, the scrubber 501 stirs up the debris 113 which may then be caught by water current. Even though the scrubber 501 is placed just slightly ahead of the mouth, the agitation of the debris and the suction at the mouth is near enough for the water current to buoy the agitated debris. Being near the mouth 109 allows the debris 113 to be sucked into the housing 101 before the debris 113 settles again on the pool bed 107. While this configuration is not as effective as that of FIG. 11 and FIG. 12 in preventing damage to the bristles, it is nevertheless advantageous over the prior art in being able to clean pool beds 107 of stubborn debris 113, because the scrubber 501 is proximate the mouth 109 at the bottom of the belly 115, and the suction current is stronger than if the mouth is placed at the sides or ends of the housing 101.

Figure 14:
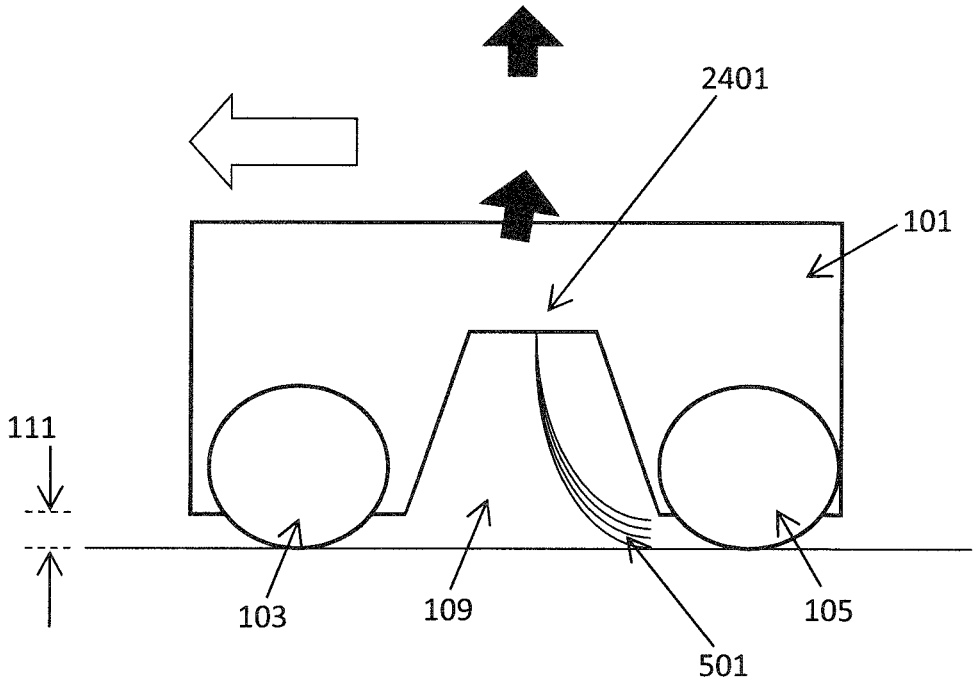
FIG. 14 shows another variation of the embodiment of FIG. 2.
Figure 15:
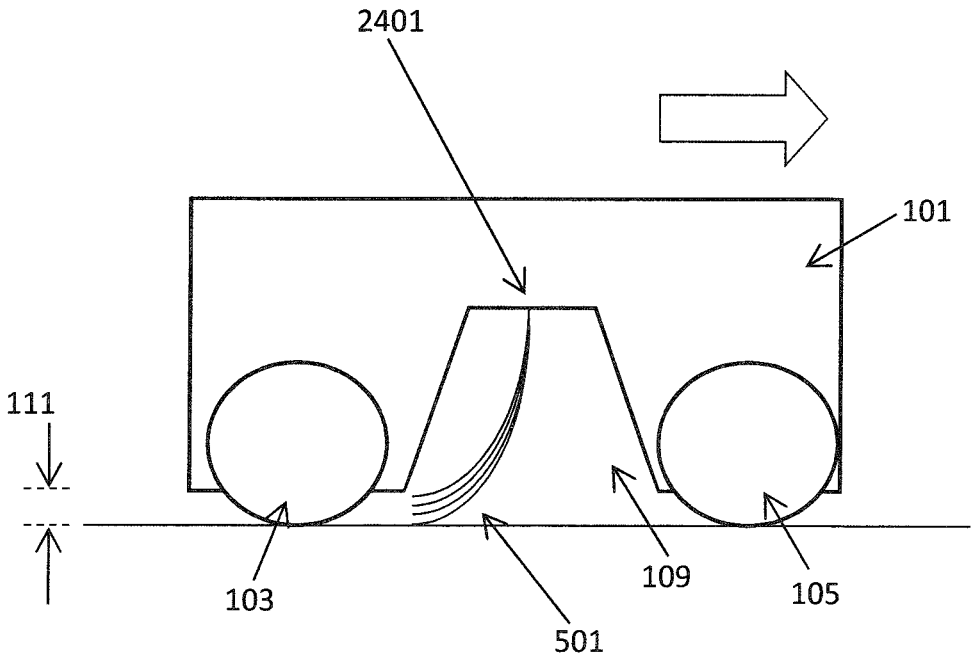
FIG. 15 further illustrates the embodiment of FIG. 14.

FIG. 14 and FIG. 15 shows yet another variation to the embodiment of FIG. 2. The scrubber 501, instead of being bristles arranged on a hard board, is a row of long bristles. The bristles can be made of long, thick, resilient plastic fibres which are not secured to a hard board. The long fibres extend from the roof of the mouth to the pool bed. The top ends of the bristles are held in a bunch at the roof of the mouth 109. The connection 2401 to the roof of the mouth 109 is a fixed connection, and is not a pivot, because the bristles can be bent naturally to let the ends of the bristles sweep across the pool bed 107, dragged behind the connection 2401.

FIG. 15 shows how a change in movement direction causes the lower ends of the bristles to be caught on the pool bed 107, and bend the other way, i.e. to drags behind the connection 2401 to sweep the pool bed 107 as the PCV 100 moves in the reverse direction.

In a variation of the embodiment of FIG. 14 and FIG. 15, the connection of the scrubber 501 to the roof of the mouth 109 may also be a pivot (not illustrated) which is movable within a vertical slide guide to allow for greater scrubber 501 freedom of movements.

Figure 16:
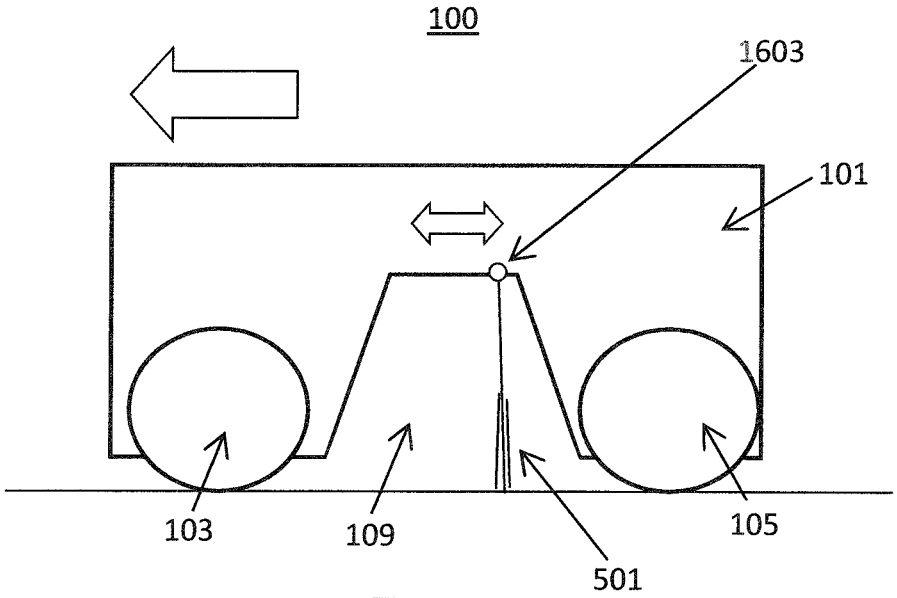
FIG. 16 illustrates a further embodiment.
Figure 17:
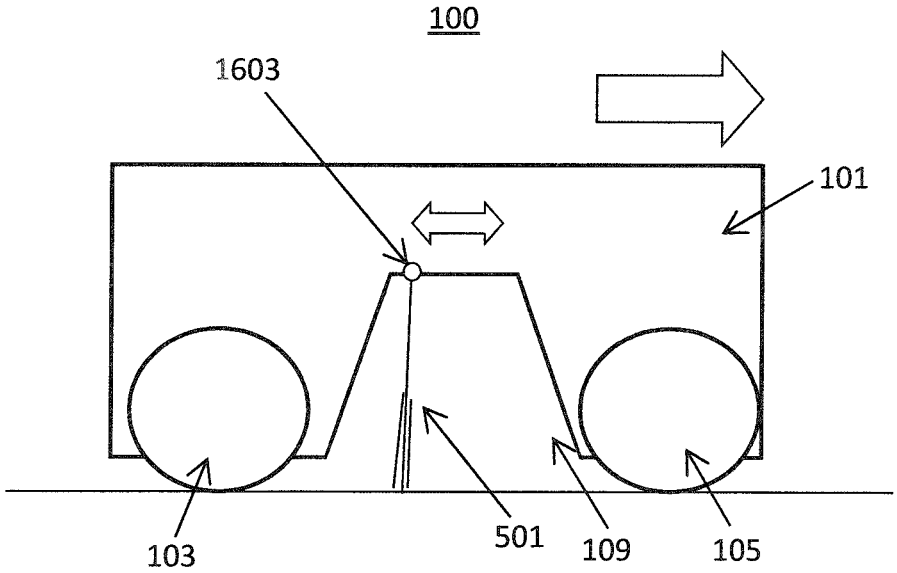
FIG. 17 further illustrates the embodiment of FIG. 16.

FIG. 16 and FIG. 17 show a further variation of the embodiments, wherein the scrubber 501 is slide-able horizontally, i.e. parallel to the plane of the pool bed. FIG. 16 shows the PCV 100 moving to the left and the scrubber 501 pushed to the right by floor friction acting on the bristles of the scrubber 501. FIG. 17 shows the PCV 100 moving to the right and the scrubber 501 pushed to the left by floor friction acting on the bristles of the scrubber 501. The scrubber 501 is slide-able because its connector 1603 to the roof of the mouth 109 is fitted within a horizontal slide guide 1801. It is possible that the scrubber 501 can be slide-able horizontally without being pivoted to swing about the connector 1603.

Figure 18:
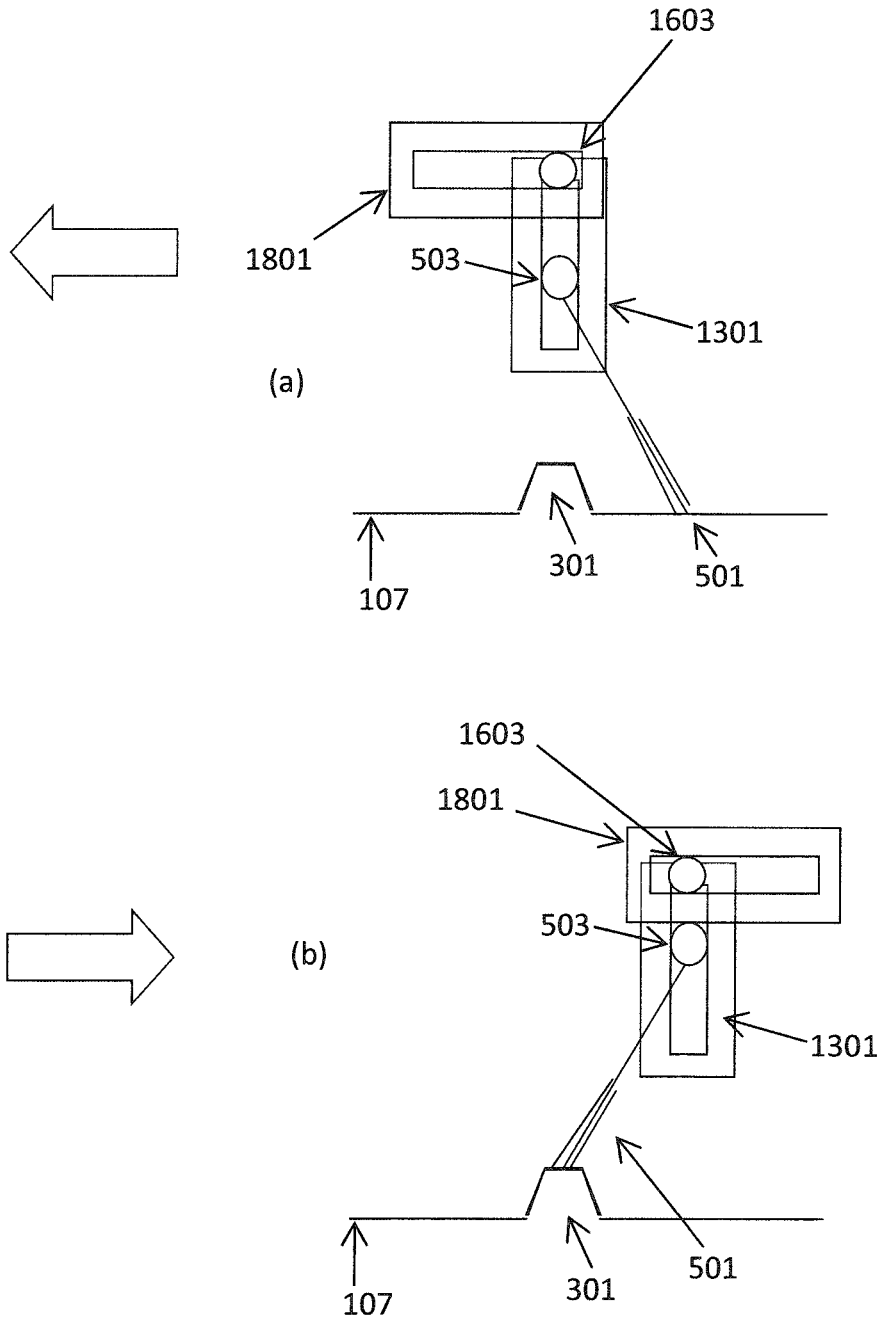
FIG. 18 also further illustrates an embodiment which is a combination of the embodiment FIG. 16 and FIG. 9.

More preferably, however, the scrubber 501 is both capable of sliding horizontally as well as sliding up and down, as well as capable of swinging about the pivot connecting the scrubber 501 to the housing 101. FIG. 18 is a series of drawings which illustrates one possible mechanism to make this possible, which is the vertical slide guide 1301 of FIG. 9 secured to the housing 101 via a horizontal slide guide 1801

FIG. 18(*a*) shows the scrubber 501 dragging on the right side when the housing 101 (not shown) is moving to the left. The connector 1603 is pushed to the rightmost end of the horizontal slide guide 1801. The pivot 503 is mid-height in the vertical slide guide 1301 as the scrubber 501 is sweeping across an even pool bed.

FIG. 18(*b*) shows the scrubber 501 dragging on the left side when the housing 101 (not shown) is moving to the right. The connector 1603 is pushed to the leftmost end of the horizontal slide guide 1801. However, the pivot 503 is now higher in the vertical slide guide 1301 than in FIG. 18(*a*) because the scrubber 501 has mounted onto an immovable protrusion 301.

Accordingly, the embodiments described include a pool cleaning vehicle 100 comprising: a housing 101 having a base; a mouth 109 on the base for sucking debris 113 on the bed of a pool; and a scrubber 501 extending from within the mouth 109 to agitate the debris 113.

The embodiments described also include a pool cleaning vehicle 100 comprising: a housing 101; and a scrubber 501 pivoted to the housing 101 to agitate the debris 113.

The embodiments described also include a pool cleaning vehicle 100 comprising: a housing 101; and a scrubber 501 slide-ably connected to the housing 101 to agitate the debris 113.

The embodiments described also include a method of cleaning a pool bed 107 comprising the steps of: providing scrubber 501 extending from within the mouth 109 of a suction cleaner (the PCV 100); scrubbing debris 113 on the pool bed 107 using the scrubber 501; wherein debris 113 which is agitated by the scrubber 501 is sucked by the suction at the mouth 109.

While there has been described in the foregoing description preferred embodiments of the present invention, it will be understood by those skilled in the technology concerned that many variations or modifications in details of design, construction or operation may be made without departing from the scope of the present invention as claimed.

The invention claimed is:

1. A method of cleaning a pool bed comprising the steps of:

providing a pool cleaning vehicle comprising:

a housing having a base;

a mouth on the base for sucking debris on the bed of a pool;

a pair of slide guides, wherein one of the pair of slide guides is formed on each opposing end of the mouth;

a pivot positioned in each of the pair of slide guides; and a scrubber attached to the pivot in each of the pair of slide guides;

scrubbing debris on the pool bed using the scrubber by moving the scrubber upward and downwards within the mouth as the pivot in each of the pair of slide guides moves upwards and downwards within each of the pair of slide guides as the pool cleaning vehicle travels over undulations along the pool bed; wherein debris which is agitated by the scrubber is sucked by the suction at the mouth.

2. A method of cleaning a pool bed as claimed in claim 1, further comprising the steps of:

dragging the scrubber as the suction cleaner moves.

3. A method of cleaning a pool bed as claimed in claim 1, further comprising the steps of:

lifting the scrubber over a protrusion on the pool bed as the suction cleaner moves over the protrusion by moving the scrubber upward within the mouth as the pivot in each of the pair of slide guides moves upwards within each of the pair of slide guides as the pool cleaning vehicle travels over the protrusion on the pool bed.

4. A method of cleaning a pool bed as claimed in claim 1, further comprising the steps of:

lowering the scrubber into a crevice on the pool bed as the suction cleaner moves over the crevice by moving the scrubber downwards within the mouth as the pivot in each of the pair of slide guides moves downwards within each of the pair of slide guides as the pool cleaning vehicle travels over the crevice on the pool bed.

* * * * *